US005901983A

United States Patent [19]

Bini

[11] Patent Number: 5,901,983

[45] Date of Patent: May 11, 1999

[54] BOOK

[75] Inventor: Renata Bini, Milan, Italy

[73] Assignee: Happy Books, S.R.L., Milan, Italy

[21] Appl. No.: 08/866,533

[22] Filed: May 30, 1997

[51] Int. Cl.[6] ..... B42D 1/00

[52] U.S. Cl. ..... 281/38; 281/51; 283/63.1

[58] Field of Search ..... 281/15.1, 21.1, 281/38, 51; 283/63.1; 462/55

[56] References Cited

U.S. PATENT DOCUMENTS

| | | | |
|---|---|---|---|
| 728,625 | 5/1903 | Schumacher | 281/38 |
| 1,835,909 | 2/1931 | Shoemaker | 281/38 |
| 4,969,665 | 11/1990 | Thiaville | 281/51 |
| 5,383,684 | 1/1995 | Smath | 281/51 |
| 5,653,470 | 8/1997 | Bennett | 281/51 |

*Primary Examiner*—Willmon Fridie, Jr.

*Attorney, Agent, or Firm*—Laff, Whitesel, Conte & Saret, Ltd.

[57] ABSTRACT

A book (1) is disclosed which comprises a predetermined number of pages (2) placed in mutual-superposition relationship and mutually engaged at a binding area (3) thereof, in which each of said pages has a shaping contour (4) having an overall dimension seen in plan which is greater than that of the page superposed thereon to define a profile of the book with a stepwise decreasing extension.

13 Claims, 2 Drawing Sheets

FIG. 1
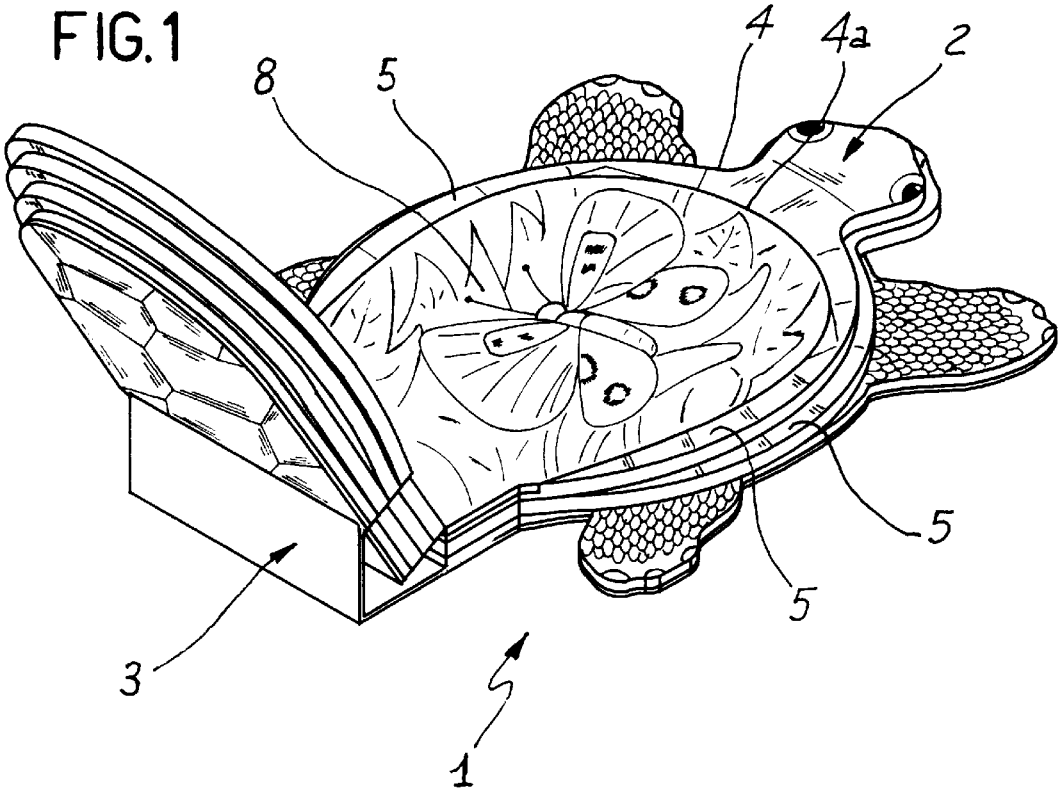
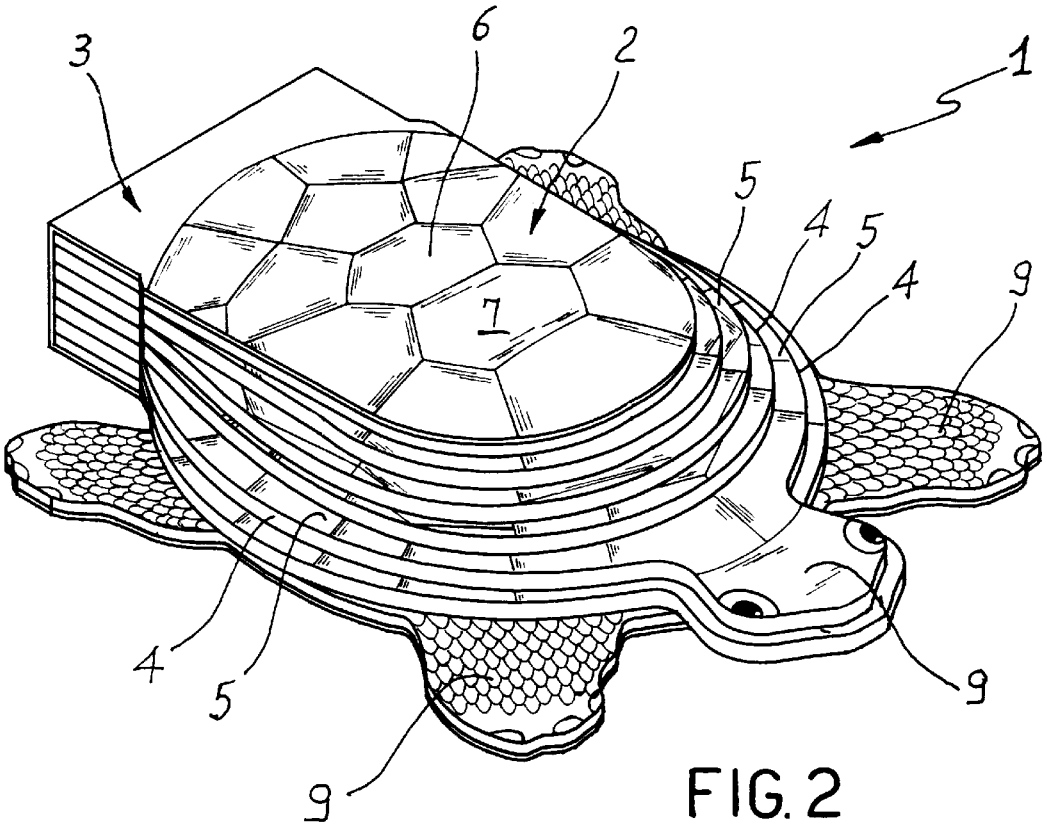
FIG. 2

FIG. 4
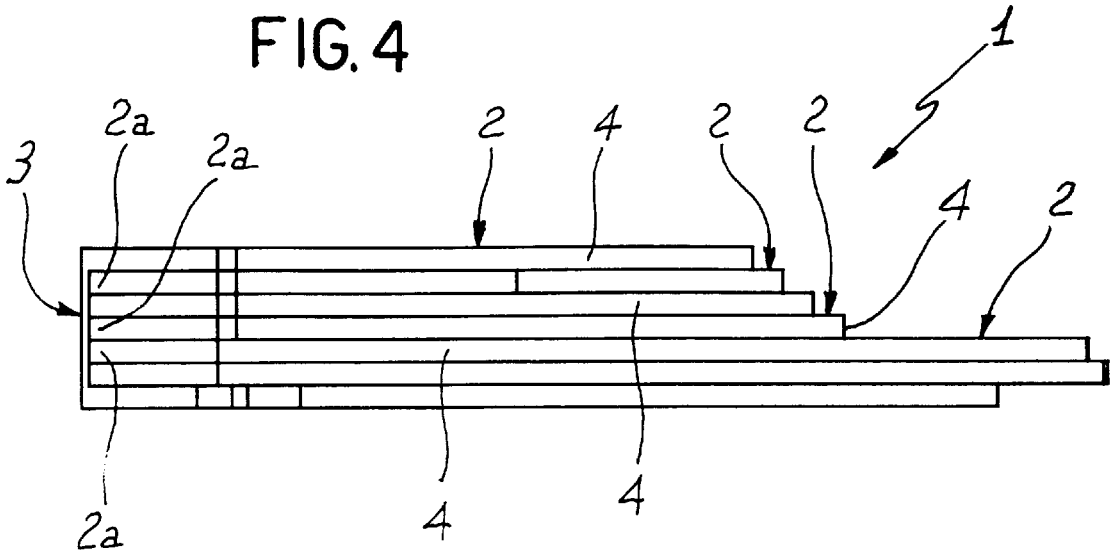
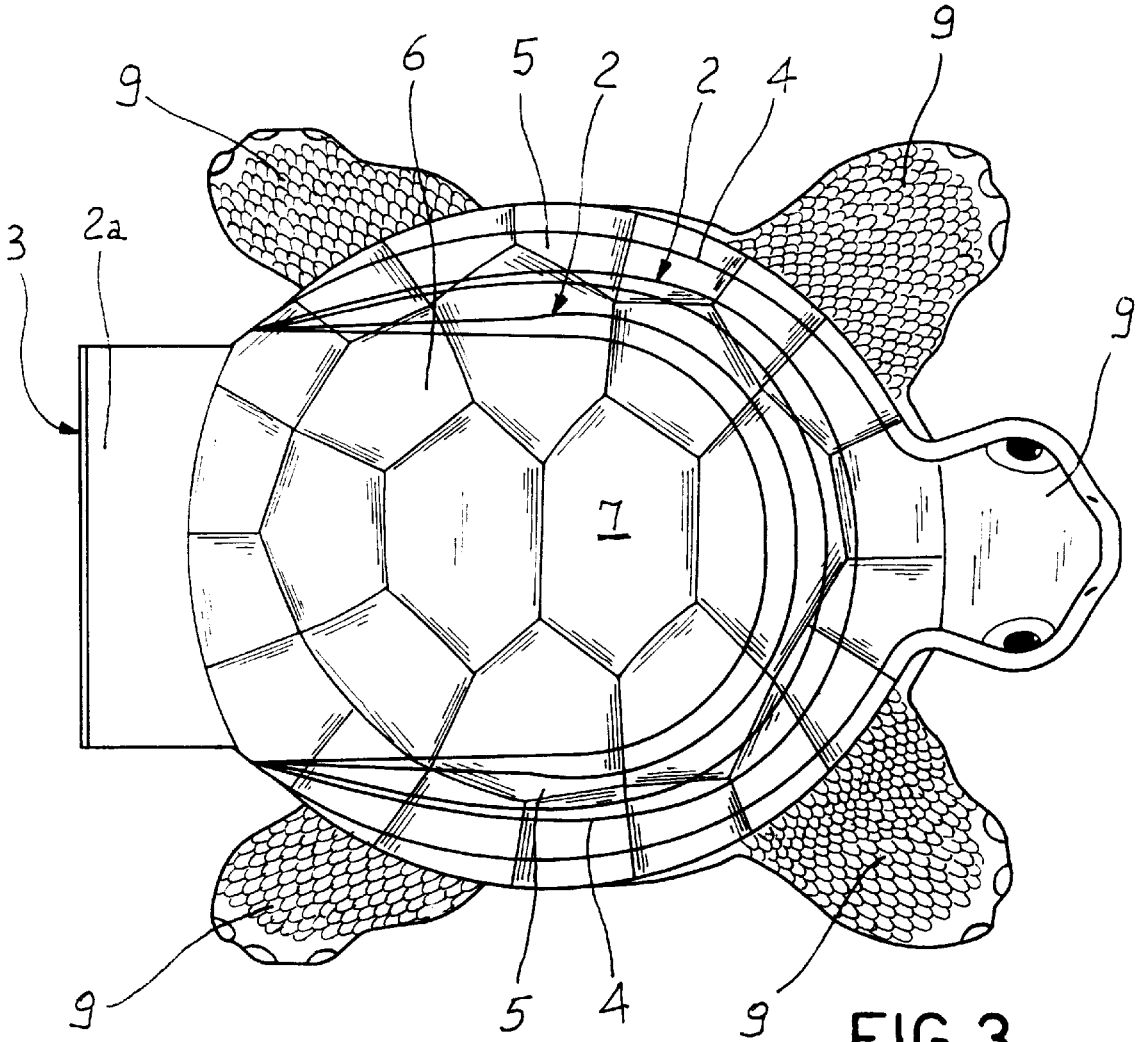
FIG. 3

BOOK

BACKGROUND OF THE INVENTION

1. Field of the Invention

The present invention relates to a book. In particular, the invention pertains to a book intended for use by children and therefore typically to a book in which pages have such a structure and conformation to ensure an appropriate strength and the capability Of easily turning over the pages of the book itself.

2. Prior Art

It is known that there are on the market different typologies of books intended for use by children.

In particular, for children of a few years of age, books made of paperboard, wood, plastics or other similar materials have been recently widespread, in which each of the pages has a relatively high thickness and rigidity, thereby ensuring a perfect planar arrangement of the pages, a great strength of the whole brochure and an easy accessibility by the child to the different pages forming the book.

Actually, it is apparent that strength and easy handling are essential requisite features for goods adapted to be used by children.

On the other hand, in this type of goods greatly felt is also the requirement of making books having a pleasant and winning aesthetic aspect. For the purpose, commercially available books bound in paperboards or plasticized have been provided with perimetric edges having the most different shapes so as to give the book particular conformations such as those of animals, flowers, toys, means of transport or still other conformations for example, in order to draw attention to these goods by the public for which they are intended.

In addition, in order to improve both the aesthetic aspect and accessibility to each page, some of these books have been provided, at one side or edge portion thereof, with suitably shaped protuberances to define page-selection areas, of the same type as present in notebooks, or shaped as mere bulges each disposed on a respective page, at mutually offset positions.

Although they are greatly widespread, all books of the above described type in any case have pages of the same shape and therefore define a book that in conclusion has a conformation substantially in two dimensions.

Under this situation, the present invention fundamentally aims at providing a new book which is capable of greatly improving the visual effect offered to the user. In particular, it is a fundamental object of the invention to provide a book capable of greatly increasing the three-dimensional character in the graphic motifs represented thereon.

A further object of the invention is to make a new book for children in which, by virtue of the particular structure and mutual arrangement of pages, an improved handling capability and accessibility to the individual pages is achieved relative to the books of known type presently on the market.

Finally, it is a further object of the invention to provide a book for children which is also feasible in an easy manner, with apparatuses of the traditional type and at reduced costs.

SUMMARY OF THE INVENTION

The foregoing and further objects that will become more apparent in the progress of the present description are substantially achieved by a book comprising a predetermined number of pages disposed in mutual-superposition relationship and mutually engaged at a binding area, each of said pages having a shaping contour defining a predetermined plan form for each page; the shaping contour of each page having an overall dimension seen in plan which is greater than that of the page superposed thereon, at least over one prevailing portion of its extension.

BRIEF DESCRIPTION OF THE DRAWINGS

Further features and advantages will be best understood from the detailed description of a preferred but non-exclusive embodiment of a book in accordance with the present invention which is given hereinafter by way of non-limiting example, with reference to the accompanying drawings, in which:

FIG. 1 is a perspective view of a book in accordance with the invention seen in an open condition at a given page;

FIG. 2 is a perspective view of the book shown in FIG. 1 in a closed condition;

FIG. 3 is a plan view of the book seen in FIG. 2; and

FIG. 4 is a side view of the book shown in FIG. 2.

DESCRIPTION OF THE PREFERRED EMBODIMENT

With reference to the accompanying drawings, a book in accordance with the present invention has been generally identified by reference numeral 1.

It is to point out that book 1 is particularly intended for use by children even if, obviously, the new features of book 1 can also be applied to books intended for a different type of public.

Book 1 is formed of a predetermined number of pages 2 disposed in mutual-superposition relationship and mutually engaged at a binding area 3. In particular, in the embodiment shown the binding area 3 is defined at an end edge 2*a* of each page and can consist of a mere connection between the different end edges of each page or a binding by means of rings or still other types.

Each page 2 has a shaping contour or edge 4 defining the plan shape of each page, as particularly seen in FIG. 3.

In more detail, the shaping contour of each page has a differentiated conformation relative to the shaping contour of the other pages.

In addition, advantageously, the shaping contour 4 of each page, at least over one prevailing length of its extension, has an overall dimension, seen in plan, greater than that of the page superposed thereon. In other words, the shaping contour of each page defines a line containing the orthogonal projection, carried out on the page in question, of the shaping contour of the preceding page (this can be clearly seen both in FIG. 3 and FIG. 4).

Preferably, it is to note that the shaping contour 4 of each page has an overall dimension seen in plan, substantially over its whole extension, which is greater than that of the page superposed thereon. Practically, the shaping contours of the different pages will be substantially coincident with each other only at the above mentioned binding area 3. By virtue of this particular conformation, the book in accordance with the invention has a three-dimensional structure, in that the various pages give the book itself a shape substantially corresponding to that of a truncated pyramid of gradually decreasing profile. It is important to point out that usually pages of books intended for use by children have a thickness higher than a given value, normally included between two and five millimeters. The foregoing, in combination with the above listed features, gives the book a profile of a stepwise decreasing extension, which further increases the three-dimensional effect that the book will take, in particular in a closed condition (see FIG. 2).

In accordance with another important aspect of the invention, it is to note that on an upper face of each page following the top page 6 a perimetric band 5 can be defined, which is externally delimited by the shaping contour 4 of the page itself and internally delimited by a line 4*a* coincident with or internal to the orthogonal projection onto this very page of the shaping contour of the page superposed thereon. In other words, line 4*a* of each page does not emerge from the area defined by the orthogonal-projection line of the shaping contour of the preceding page onto the page in question.

Advantageously, the perimetric band 5 has a variable width along the shaping contour 4, which expedient can be utilized for further increasing the three-dimensional effect that can be offered by the book.

It is important to point out that in the book in accordance with the invention the top page 6 has an upper face on which a first graphic motif 7 is defined and a lower face (not shown) on which at least one second graphic motif differentiated from the first one can be defined.

By way of example, in FIG. 2, a book is shown in which the first graphic motif consists of the representation of a tortoise, whereas the second graphic motif could consist of the graphic representation of a scene from a tale or other. Advantageously, pages following the top page, intended for being placed consecutively under the top page, each have respective portions complementary to the first graphic motif, in this case the tortoise representation, disposed on the perimetric band 5. In addition pages following the top page, still at their upper and/or lower faces, have a central area 8 internal to the perimetric band on which another graphic motif is placed, which motif may be the same as the second graphic motif or differentiated therefrom, depending on wishes. By way of example, shown in FIG. 1 is book 1 open at an intermediate page reproducing a second graphic motif at the central area 8 delimited by line 4*a*.

Preferably, each page following the top one has a lower face on which no perimetric band is defined and therefore representation of any graphic motif, the same graphic motif as the second one for example, can be reproduced over the whole area of said lower face.

By virtue of the above described structural conformation, not only the different perimetric bands 5 of each page give a three-dimensional effect due to the fact that they are practically in the form of subsequent steps but, since complementary portions of the first graphic motif are represented thereon, they are capable of giving a very realistic idea of the subject matter reproduced as the first graphic motif (see FIG. 1 again).

Advantageously, book 1 is also comprised of a predetermined number of pages provided with auxiliary protuberances 9 externally emerging away from the shaping contour 4; said protuberances too have an upper face on which further complementary portions of the first graphic motif are reproduced.

As can be seen from the example illustrated in the drawing, these auxiliary protuberances have complementary portions of the graphic motif showing a tortoise on their upper face and they too surely help in improving the three-dimensional effect of the book being the object of the present invention.

The invention achieves important advantages.

It is actually to note that the particular conformation and size of the contour of each page as compared with the shaping contour of the preceding or following pages gives the book as a whole a three-dimensional aspect never achieved until now and, surely, an improved and much more winning aesthetic effect than the books of a traditional typology.

In particular, due to the presence of complementary portions of the first graphic motif on the perimetric band 5 of each page as well, and also on the upper face of the auxiliary protuberances, the three-dimensional effect of the book is maximized.

It should be also recognized that due to the presence of the perimetric band, obviously in combination with an appropriate thickness for each page, greatly improved is also the user's accessibility to each page as compared with traditional books, even of the notebook type.

A child for example will be able to act on any contour point of each page and, by taking hold of the perimetric edge, to select the page in which he/she is interested in a very easy manner.

Finally, from the manufacturing point of view it is to note that the book of the invention, while reaching the intended fundamental aims, can be produced in a very easy and economical manner by conventional die-cutting operations typical of books bound in paperboards or plasticized presently, available on the market.

What is claimed is:

1. A book comprising:

a given number of pages placed in mutual-superposition relationship and mutually engaged at a binding area thereof, each of said pages having a shaping contour defining a predetermined plan form for each page;

the shaping contour of each page having an overall dimension seen in plan which is greater than that of the page superposed thereon;

a perimetric band can be defined on each page thereof, which band is externally delimited by the shaping contour of the page itself and internally delimited by a line substantially coincident with the orthogonal projection onto this very page of the shaping contour of the page superposed thereon, said perimetric band being of variable length along the shaping contour;

said given number of pages having a top page having an upper face on which a first graphic motif is defined and a lower face on which at least one second graphic motif is defined, said given number of pages further comprising subsequent pages intended for being disposed consecutively under said top page and each subsequent page being provided, on an upper face thereof, with respective portions complementary to said first graphic motif, placed on said perimetric band.

2. The book as claims in claim 1 wherein the dimension seen in plan is greater than that of the page superposed thereon over a substantial portion thereof.

3. The book as claimed in claim 1, wherein each of said pages has a thickness to give the book a profile with a stepwise decreasing extension.

4. The book as claimed in claim 1, comprising a predetermined number of pages, each of said pages provided with protuberances externally emerging away from said shaping contour.

5. The book as claimed in claim 4, wherein said protuberances have an upper face on which further portions complementary to the first graphic motif are reproduced.

6. The book as claimed in claim 4, wherein said auxiliary protuberances have an upper face on which further portions complementary to the first graphic motif are reproduced.

7. The book as claimed in claim 1, wherein the shaping contour of each page has a differentiated conformation from the shaping contour of the other pages.

8. A book comprising:

a given number of pages placed in mutual-superposition relationship and mutually engaged at a binding area thereof, each of said pages having a shaping contour defining a predetermined plan form for each page;

the shaping contour of each page having an overall dimension seen in plan which is greater than that of the page superposed thereon;

a perimetric band can be defined on each page thereof, which band is externally delimited by the shaping contour of the page itself and internally delimited by a line internal to the orthogonal projection onto this very page of the shaping contour of the page superposed thereon, said perimetric band being of variable length along the shaping contour;

said given number of pages having a top page having an upper face on which a first graphic motif is defined and a lower face on which at least one second graphic motif is defined, said given number of pages further comprising subsequent pages intended for being disposed consecutively under said top page and each subsequent page being provided, on an upper face thereof, with respective portions complementary to said first graphic motif, placed on said perimetric band.

9. The book as claimed in claim 8 wherein the dimension seen in plan is greater than that of the page superposed thereon over a substantial portion thereof.

10. The book as claimed in claim 8, wherein each of said pages has a thickness to give the book a profile with a stepwise decreasing extension.

11. The book as claimed in claim 8 wherein the shaping contour of each page has a differentiated conformation from the shaping contour of the other pages.

12. The book as claimed in claim 8 comprising a predetermined number of pages, each of said pages provided with protuberances externally emerging away from said shaping contour.

13. The book as claimed in claim 12 wherein said protuberances have an upper face on which further portions complementary to the first graphic motif are reproduced.

* * * * *